United States Patent [19]

Kurachi et al.

[11] 4,316,503

[45] Feb. 23, 1982

[54] SOLDERLESS HEAT EXCHANGER

[75] Inventors: Shogo Kurachi, Nishio; Masami Tamura, Kariya; Akio Ueda, Nagoya, all of Japan

[73] Assignee: Nippondenso Co., Ltd., Kariya, Japan

[21] Appl. No.: 187,959

[22] Filed: Sep. 16, 1980

[30] Foreign Application Priority Data

Oct. 12, 1979 [JP] Japan ..... 54-132146

[51] Int. Cl.[3] ..... F28F 9/16

[52] U.S. Cl. ..... 165/175; 29/157.4; 29/523; 285/137 R; 285/192; 285/222

[58] Field of Search ..... 29/157.4, 523; 165/148, 165/151, 173, 175, 178; 285/137 R, 222, 382.4, 162, 192

[56] References Cited

U.S. PATENT DOCUMENTS

| | | | |
|---|---|---|---|
| 1,137,600 | 4/1915 | Gallagher | 29/157.4 |
| 3,349,465 | 10/1967 | Pan et al. | 29/157.4 |
| 3,583,478 | 6/1971 | Fieni | 165/178 |
| 4,159,741 | 7/1979 | Nonnenmann et al. | 165/173 |
| 4,226,280 | 10/1980 | Cenival et al. | 165/173 X |

FOREIGN PATENT DOCUMENTS

| | | | |
|---|---|---|---|
| 2813952 | 10/1979 | Fed. Rep. of Germany | 165/178 |

*Primary Examiner*—Sheldon J. Richter

*Attorney, Agent, or Firm*—Cushman, Darby & Cushman

[57] ABSTRACT

A solderless type heat exchanger having an upper and lower tanks, header plates closing the opposing opened ends of respective tanks, a plurality of tubes extending through the head plates to provide a communication between the upper and lower tanks, and a plurality of plate fins attached to the outside of the tubes, the tubes being joined to the header plates and plate fins solely by pressure contact therebetween provided through expansion of the tubes. The header plate is provided with a collared portion around each bore for receiving the corresponding tube and an annular groove is formed around the periphery of each collared portion. The annular groove provides a resiliency which ensures the rigid and stable joint between the tubes and the header plate achieved solely by the pressure contact through the expansion of the tube.

5 Claims, 13 Drawing Figures

SOLDERLESS HEAT EXCHANGER

BACKGROUND OF THE INVENTION

The present invention relates to a heat exchanger and, more particularly, to a solderless heat exchanger which is assembled with mechanical measure such as tube expansion or the like, without using any soldering, suitable for use as radiator of automobile engine, warm-water circulation type heat radiator of air conditioner or the like purpose.

FIGS. 1 and 2 show the connection between a header plate 5 and a tube 1 in a conventional heat exchanger. In this connecting construction, an elastic sealing member 6 is interposed between the collar portion 5*a'* of the header plate 5 and the end portion 1*a* of the tube. This arrangement provides a sufficiently large buffering effect against external force but the number of parts is impractically increased to incur a rise of the production cost, as well as an increase of the weight. Further, the elastic sealing member 6 which is usually made of high molecule compound of rubber group does not have sufficient durability under a high temperature and chemical environment.

FIG. 2*a* shows another known heat exchanger disclosed in the specification of U.S. Pat. No. 4,159,741. In this known heat exchanger, it is extremely difficult to obtain a dynamical balance of the force caused by the permanent deformation of the tube end when the tube is expanded, within the region of elastic deformation of the header plate collar 5*a'*, so that an extremely high precision of work is required in the fabrication of the heat exchanger. This not only makes the fabrication difficult but also poses a problem that the sealing effect is deteriorated due to an insufficient surface pressure (See FIG. 2*b*) when the above-mentioned dynamical balance is lost.

Furthermore, since the surface pressure of the joint surface A is drastically changed at an intermediate point as shown in FIG. 2*b*, the header plate 5 suffers a fatigue to reduce its durability, particularly when the heat exchanger is used under such a condition as involving continuous vibration and torsion as in the case of the radiator of automobile engine.

SUMMARY OF THE INVENTION

Under these circumstances, the present invention aims as its major object at providing a less expensive heat exchanger which is easy to fabricate and which has a sufficient durability, thereby to overcome the above-described problems of the prior art.

Another object of the invention is to provide a heat exchanger in which an annular groove capable of making an elastic deformation is formed on the periphery of the collar portion of header plate, and the tubes extending through the collar portion is joined to the latter only through a pressure contact.

DESCRIPTION OF THE PREFERRED EMBODIMENTS

Preferred embodiments of the invention will be described hereinunder with reference to the accompanying drawings.

Figure 1A:
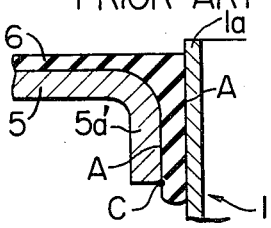
FIG. 1a PRIOR ART
FIGS. 1*a*, 1*b* and FIGS. 2*a* and 2*b* show the joint between the header plate 5 and tube 1 in conventional heat exchangers and schematic distribution of internal force in the joint.
Figure 1B:
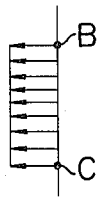
FIG. 1b PRIOR ART
Figure 2A:
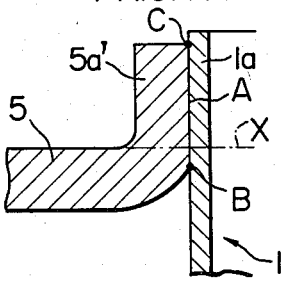
FIG. 2a PRIOR ART
Figure 2B:
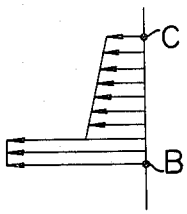
FIG. 2b PRIOR ART
Figure 3:
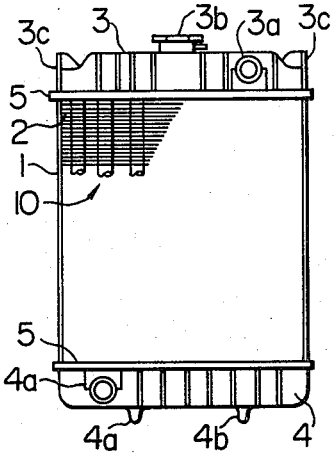
FIG. 3 is a front elevational view of a heat exchanger constructed in accordance with an embodiment of the invention.
Figure 4:
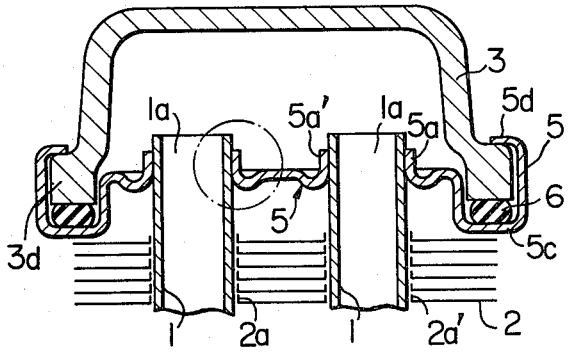
FIG. 4 is a sectional view showing the connection between a header plate and tubes in the heat exchanger shown in FIG. 3.

FIGS. 3 and 4 show a first embodiment of the invention applied to a radiator for automobile engine. A reference numeral 1 denotes a tube made of an aluminum alloy and having an outside diameter and a thickness of 8 mm and 0.5 mm, respectively. Materials other than aluminum alloy can be used as the material of the tube 1 provided that the weight is small and the heat conductivity is large. A plate fin 2 made of aluminum and 0.1 mm thick have collared tube insertion bores of a number corresponding to the number of the tubes 1 and formed beforehand by burring. Each tube insertion bore 2*a* has an outer diameter of 8.3 mm which is 0.3 mm greater than that of the tube 1. The outside diameter of the tube insertion bore 2*a*, however, can be selected from the region which is 0.2 to 0.4 mm greater than the outside diameter of the tube 1. As to the shape of the fin, louvers (not shown) of any desired form is formed in the fin to increase the heat transfer coefficient of the fin.

A reference numeral 5 denotes an aluminum header plate having a substantially uniform thickness of 1.5 mm and is provided with collared bore portions 5*a* the outer diameter of which is 8.4 mm, i.e. 0.1 mm greater than that of the bore 2*a* of the fin 2. The aforementioned tube 1 and the fin 2 in combination constitute a core portion 10. By making an expansion of tube from outside diameter of 8 mm to 8.4 mm, the outer surface of the tube 1 makes metallic contact with the collar portions 2*a'* and 5*a'* of the fin 2 and the header plate 5 to fix the tube 1 to these members.

Reference numeral 3 and 4 denote tanks shaped from a glass-fiber-reinforced nylon resin. The upper tank 3 has an inlet pipe 3*a*, water filling pipe 3*b* and a bracket 3*c* for attaching to the automobile, formed integrally with the tank body. Also, the lower tank 4 is provided with an outlet pipe 4*a* and legs 4*b* for fixation of the automobile body, formed integrally with the tank body.

Aluminum is suitably used as the materials of the tube 1, fin 2 and the header plate 5. Preferably, aluminums such as A 1050 and A 3003 and aluminum alloys containing zinc, manganese and the like, such as 72S, having a sacrifice corrosion effect on the aluminum surface are used. It is also recommended to compose the header plate with aluminum material such as A 5052 so that the header plate may exhibit a rigidity and mechanical strength greater than those of the material of the tubes 1.

A reference numeral 6 denotes an elastic sealing member interposed between the opened end 3*d* of the tanks 3, 4 and the periphery 5*b'* of the header plate 5. The sealing member has a circular cross-section of 3.5 mm dia. and is made of ethylene propylene rubber.

In the heat exchanger having the described construction, engine cooling water circulated through the automobile engine is introduced into the upper tank 3 through the inlet pipe 3*a* and is distributed to all tubes 1. As the cooling water flows through these tubes 1, a heat exchange is made between the engine cooling water and cooling air which is forcibly applied to the outside of the tubes by a blower or fan not shown. The cooled cooling water is then recirculated to the engine from the lower tank 4 via the outlet pipe 4*a*.

The heat exchanger of the described embodiment is assembled in a manner shown below.

Figure 9:
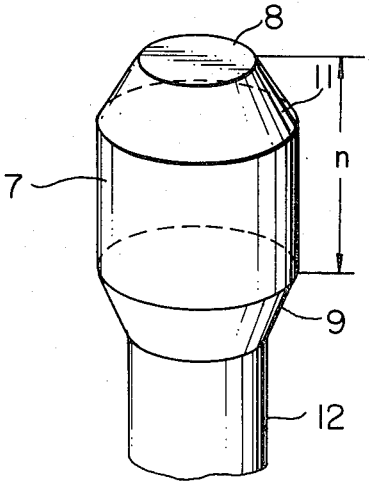
FIG. 9 is a perspective view of an expander jig used in the expansion of tubes.

A desired number of plate fins 2 each having louvers (not shown) and collared tube insertion bores 2*a* are superposed in alignment with each other, and the header plate 5 is disposed on the upper and lower sides of the laminated body of the plate fins 2. Thereafter, tubes 1 are inserted into corresponding bores 2*a* and 5*a* of the plate fins 2 and header plates 5. Then, a tube expanding frustoconical jig 7 as shown in FIG. 9 is inserted into each tube to expand the latter from the outside diameter of 8 mm to 8.4 mm thereby to fix the fins 2 and the header plates 5.

The tube expanding jig 7 has a frustoconical head 11 and a supporting rod 12. The top of the frustoconical head 11 has a circular form of a diameter of 5.0 mm, while the lower end 9 of the head 11 has a circular form of a diameter of 7.4 mm. The height n of the head 11 is 10 mm. The supporting rod 12 is concentrically fixed to the lower end 9 of the head. The outer surface of the tube end 1*a* are forced to make pressure contact with the inner peripheral surfaces of the collared portions 2*a'*, 5*a'* of the fin 2 and the collar 5 by means of this tube expanding jig 7.

Thereafter, the aforementioned elastic sealing member 6 is interposed between the periphery 5*c* of the header plate 5 and the end 3*b* of the tank 3, 4, and the projecting end 5*d* of the periphery 5*b* is caulked onto the opened end 3*d* of the tank 3, 4, thereby to join the header plate 5, 5 and the tank 3, 4 in a watertight manner.

The whole of the heat exchanger shown in FIG. 3 is thus assembled.

Hereinafter, a description will be made as to the construction and function of the collared bore 5*a* of the header plate which constitutes an essential feature of the invention, with specific reference to FIG. 5.

The axial length of the collared portion 5*a'* constituting the joint surface A, i.e. the distance between the points B and C is 3 mm, whereas the height m of the collared portion 5*a'* falls within the range of between [a value of the sum of the distance from the points B to C and the thickness of the header plate] and [another value of the sum of the distance from the points B to C and a double of the thickness of the header plate].

In the solderless type heat exchanger of the kind described, the state or quality of the contact between the tube and 1*a* and collared portion 5*a'* of the header plate influences the quality of the fixation between the tube 1 and the header plate, i.e. the sealing performance. From this point of view, it is essential to maintain at the joint interface A (the area from the point C to the point B) a suitable pressure contact relation between the collared portion 5*a'* of the header plate and the tube end 1*a* and a suitable distribution of such pressure, after the expansion of the tube 1.

Particularly, when the heat exchanger is used as the radiator for automobile engine, it is necessary to provide a sufficiently strong joint between the tube 1 and the header plate 5, in order to withstand the repetitional change of statical internal stress attributable to the change of the cooling water temperature, as well as mechanical load such as vibration, torsion and so forth.

For this reason, according to the invention, an annular groove 5*b* having a depth l of 1.2 mm, which is smaller than the plate thickness of the header plate 5, is formed by an annular corrugation in the header plate around the collared portion 5*a'*. The groove 5*b* has a cross section which is of a substantially semi-circular shape of a radius l.

Figure 5:
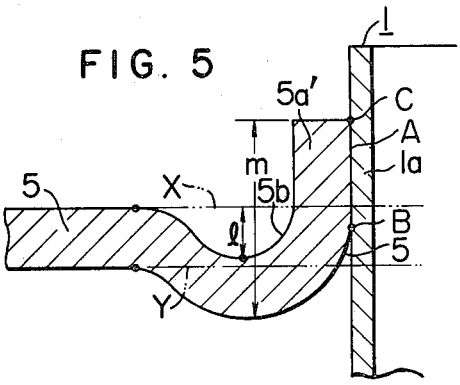
FIG. 5 is an enlarged sectional view of a major part of the structure shown in FIG. 4.
Figure 6A:
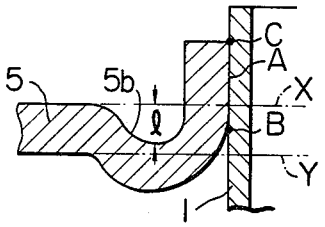
FIGS. 6*a* and 6*b* are drawings illustrating the joint between the header plate and the tube and the distribution of surface contact pressure at that joint in the heat exchanger shown in FIG. 3.
Figure 6B:
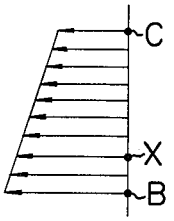

In FIG. 5, imaginary lines X and Y represent relative position relationship between the header plate 5 and the point B in the joint interface A. Also, the point B which is at a position closest to the fin 2 in the joint interface between the collared portion 5*a'* and the tube end 1*a*, is located at a position closer to the fin 2 than the imaginary line X. Needless to say, the collared portion 5*a'* of the header plate 5 and the tube end 1*a* are formed to be parallel with each other so that they closely contact with each other over the entire region of the joint interface A. In consequence, as will be understood from FIG. 6*b*, the joint interface A is subjected to a stress caused by the elastic deformation of the groove 5*b* to porduce the maximum pressure at the point B. Also, a considerably high surface contact pressure is generated over the joint interface A and is distributed over the entire area of the latter without drastical variation in the contact surface pressure at any intermediate point in the joint interface A.

It is also to be pointed out that, when the heat exchanger is subjected to an external mechanical load, the groove 5*b* makes an elastic deformation to absorb the external force thereby to greatly improve the durability of the heat exchanger.

Figure 7A:
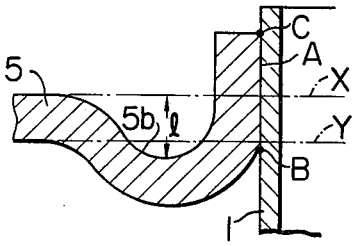
FIGS. 7*a* and 7*b* are drawings illustrating the joint between the header plate and tubes and the distribution of surface contact pressure at that joint in a heat exchanger constructed in accordance with another embodiment of the invention.
Figure 7B:
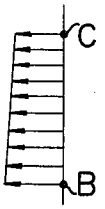
Figure 8:
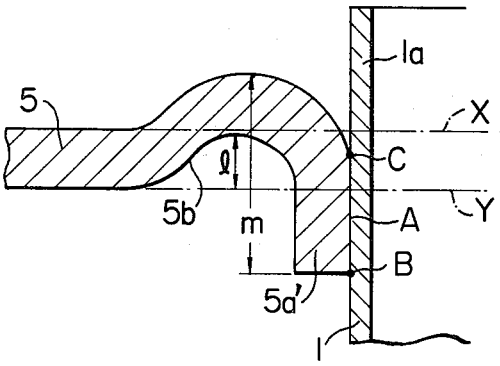
FIG. 8 is an illustration of a joint between the header plate and tubes in a heat exchanger constructed in accordance with still another embodiment of the invention.

The depth l of the groove 5*b* is selected to be 1.2 mm smaller than the thickness of the header plate 5, for the following reason. Namely, if the depth l of the groove 5*b* is made deeper than the imaginary line Y adjacent to the fin 2 as shown in FIG. 7*a*, it is not possible to obtain sufficiently large elastic force from the groove 5*b* so that the surface contact pressure is reduced as shown in FIG. 7*b* as compared with the case of FIG. 6*b*. Similarly, the point B closest to the fin 2 is such that the point B is closer to the fin than the imaginary line X as the fin 2, for making an efficient use of the resiliency of the groove 5*b*. Thus, the point B in the joint interface A is located within an area between a level (line X) of the upper surface of the header plate and another level (line Y) of the lower surface of the same.

However, since the resiliency of the groove can be increased by forming the header plate 3 with a material having large rigidity, it is possible to make the groove 5*b* have a depth l greater than the thickness of the header plate 5 and/or to position the point B in the joint interface closest to the fin 2 at a location outside the level (X–Y) of the header plate 5.

Although in the described embodiment the annular groove 5*b* has a semicircular cross-section, it is possible to form the annular groove 5*b* to have any other cross-sectional shape such as V-shape. Also, the tube 1 can have a cross-sectional shape other than circular form, e.g. an oval cross-sectional shape without being accompanied by any deterioration of the effect of the invention.

It is also possible to arrange such that the groove 5*b* is recessed toward the side of the tank 3. In such case, for the reason described already, it is preferred to locate the point C of the joint interface A closest to the tank 3 at a position closer to the tank 3 than the imaginary line Y.

What is claimed is:

1. In a heat exchanger having a pair of opposing tanks, a metal header plate of uniform thickness fixed to the open end of each of said tanks, a plurality of metal tubes extending through said header plates and providing a communication between said tanks, and a plurality of metal plate fins disposed on the outer surface of said tubes, said tubes being joined to said fins and said header plates solely through expansion of said tubes, an improvement which comprises a collared portion on the header plate formed at each joint between each header plate and each tube, and an annular corrugation formed in the plate around the periphery of each collared portion and defining an annular groove, whereby said header plate and said tube are rigidly connected to each other solely by the pressure contact therebetween, due to a resiliency provided by said annular corrugation.

2. A heat exchanger as claimed in claim 1, wherein said annular groove formed around said collared portion has a substantially semicircular cross-section of a radius smaller than the thickness of said header plate.

3. A heat exchanger as claimed in claim 1 or 2, wherein the axial length of joint interface between said collared portion and said tube is 3 mm, the thickness of said header plate is 1.5 mm and the height m of said collared portion falls within a range between a value of the sum of said axial length of said joint interface and said thickness of said header plate and another value of the sum of said axial length of said joint interface and a double of said thickness of said header plate.

4. A heat exchanger as claimed in claim 1 or 2 wherein said header plate, said tube, and said plate fin are made of aluminum alloy or alloys.

5. A heat exchanger as claimed in claim 1 or 2 wherein the point in said joint interface between said header plate and said tube, closest to said fins, is located within a region which is defined by the level of the upper surface of said header plate and the other level of the lower surface of said header plate.

* * * * *